United States Patent [19]

Meilleur

[11] Patent Number: 4,888,931

[45] Date of Patent: Dec. 26, 1989

[54] INSULATING FORMWORK FOR CASTING A CONCRETE WALL

[76] Inventor: Serge Meilleur, 501 Dominique, Ste Julie de Verchères, Quebec, Canada, J0L 2S0

[21] Appl. No.: 285,411

[22] Filed: Dec. 16, 1988

[51] Int. Cl.[4] ..... E04B 1/00

[52] U.S. Cl. ..... 52/426; 52/564

[58] Field of Search ..... 52/426, 309.2, 309.9, 52/309.12, 561, 562, 563, 564, 565

[56] References Cited

U.S. PATENT DOCUMENTS

| | | | |
|---|---|---|---|
| 1,457,981 | 6/1923 | MacDonald | 52/562 |
| 2,676,482 | 4/1954 | Wilson | 52/564 |
| 4,517,780 | 5/1985 | Lacombe et al. | 52/426 X |

*Primary Examiner*—Carl D. Friedman
*Assistant Examiner*—Jerrold D. Johnson
*Attorney, Agent, or Firm*—Bacon & Thomas

[57] ABSTRACT

There is disclosed an insulating formwork for casting a concrete wall, the formwork having a pair of sidewalls each of which is made-up of a plurality of coplanar edge-abutting modular panels made of insulating foam material. Each panel has upper and lower edges with coplanar slits provided therealong, and a pair of vertical end edges respectively provided with a tongue-and-groove to form vertical tongue-and-groove joints with other like adjoining panels. A rabbet opens onto the panel inner face and onto the panel lower edge. The panels are interconnected by a first group of angle-irons having vertical branches fitting into the upward slits, of the panels, and horizontal branches, pierced with holes, extending toward the panel inner face. The panels are also interconnected by a second group of angle-irons having vertical branches fitting into the downward slits of the panels and horizontal branches, also pierced with holes, extending toward the panel inner face and overlapping the horizontal branches of the angle-irons of the first group. The holes register together and the tie-rods hold the sidewalls together. The tie-rods have a central portion between the sidewalls and bent end portions extending through the panels. Elbows between the portions fit into the rabbets.

10 Claims, 4 Drawing Sheets

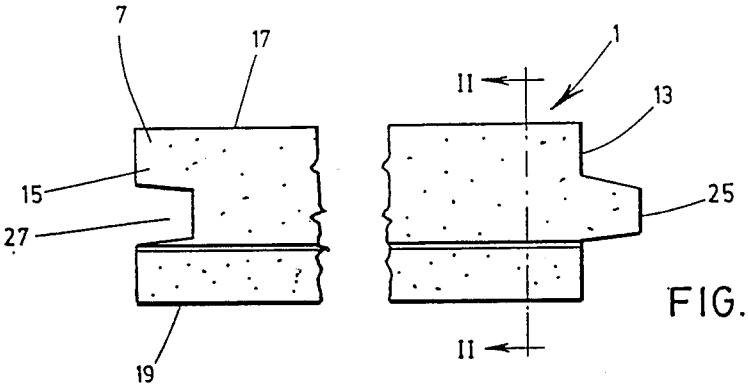
FIG. 1
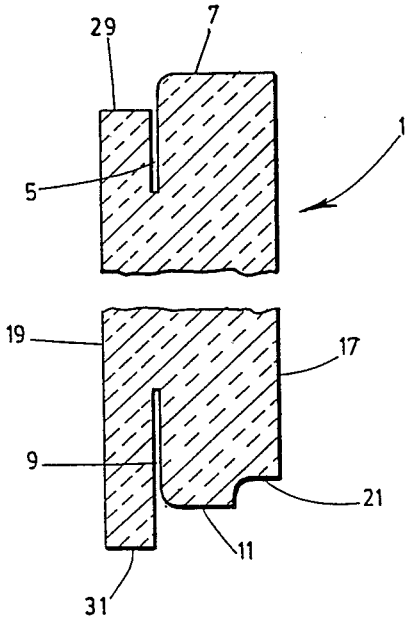
FIG. 2
FIG. 3
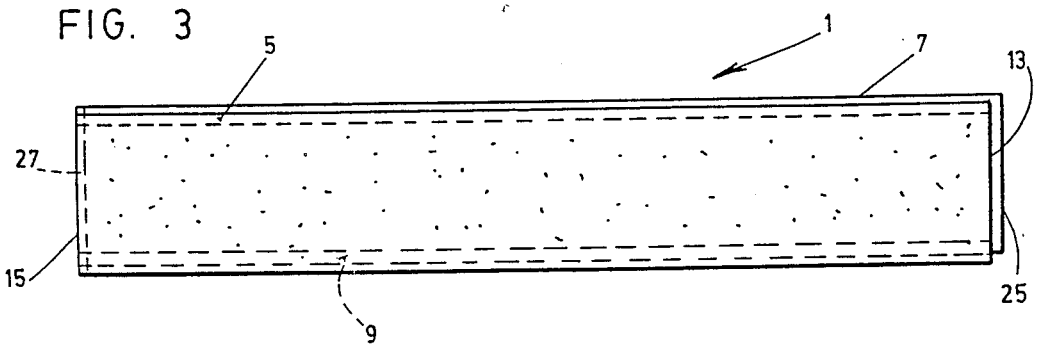

INSULATING FORMWORK FOR CASTING A CONCRETE WALL

BACKGROUND OF THE INVENTION

1. Field of the Invention

The present invention relates to an insulating modular panel and to a concrete-wall formwork of which the sidewalls are made up of such modular panels. The latter become an integral part of this wall after the concrete has set. The invention is an improvement of that in Applicant's prior U.S. Pat. No. 4,742,659 of May 10, 1988.

2. Description of the Prior Art

In the above-mentioned patent, there is disclosed a formwork made up of a series of plastic foam modules disposed in the manner of a brick wall and forming a mold into which concrete is poured; the formwork remaining permanently secured to the concrete to produce a concrete wall insulated both on the inside and on the outside. Each module is formed of two identical sections disposed in mirror position. Each module section is a panel having inner spaced ribs which terminate short of the top and bottom panel edges and inserts are embedded in the ribs; having apertures opening into the free spaced formed by the ends of the ribs and the panel edges. Once the two identical module sections are placed in mirror position, at the construction site, they are held together by horizontal tie-rods having hooked ends lockingly engaged in the insert apertures. Tie-rods of adjoining modules, disposed one above the other, are further interlocked by vertical coupling rods to prevent separation of the modules during pouring of the concrete. Reinforcement-bar supports are fixed to these coupling rods, being bent at their ends to form troughs into which horizontal reinforcement bars may be lodged.

There is no particular problem involved in the use of this type of formwork but the manufacture of the module section is complex and therefore costly involving, as it does, the embedding of inserts and the creation, by molding, of inner ribs formed with notches at the top and at the bottom. Resort must also be had to pairs of tie-rods in each module, at the bottom and at the top, as well as to coupling rods for locking together the tie-rods of adjoining modules. Additionally, these numerous components render the assembly more complex and therefore time-consuming.

SUMMARY OF THE INVENTION

It is an object of the present invention to provide formwork components of which the sidewall modules can be cut out of a standard sheet of foam plastic of convenient thickness and need no longer be molded, thereby appreciably reducing the complexity and cost of the manufacturing procedure.

Another object of the invention is to provide a formwork assembly made of a reduced number of parts of different kinds. In fact, only three kinds are required: modules of the same design for making the sidewalls; tie-rods of the same design at each joint interlocking the modules of the two sidewalls, and standard angle-irons of the same size throughout the assembly.

It is possible, in this manner, to keep inventories of parts at a low minimum and lower the time of assembling the formwork at the construction site.

More specifically, one aspect of the invention is in a modular panel made of foam plastic material and having the usual flat inner and outer faces; upper and lower horizontal edges and vertical end edges. This panel is formed with:

- longitudinal coplanar slits extending lengthwise of the upper and lower edges parallel to the inner and outer faces;
- a first ribbed opening into the inner face and into the lower edge, and
- a tongue along one of the vertical end edges and a groove along the other vertical end edge; the tongue and groove being sized to cooperate, respectively, with a groove and a tongue of like adjoining coplanar panels to form tongue-and-groove joints therewith.

According to another aspect, the invention is a concrete-wall formwork comprising a pair of sidewalls each formed a plurality of stacked rows of coplanar panels as described above. In this formwork, the ledges and the second rabbets of adjoining panels operatively cooperate to form horizontal lap joints. Similarly, the tongues and grooves of adjoining panels operatively cooperate to form vertical tongue-and-groove joints, spaced horizontally along the formwork sidewalls. Also the longitudinal slits of adjoining panels comprise upward slits in coplanar alignment with the downward slits. The formwork comprises a first group of angle-irons having vertical branches fitting into the upward slits and horizontal branches with holes therethrough; these horizontal branches extending toward the panels inner faces. A second group of angle-irons is also provided which have vertical branches fitting into the downward slits and horizontal branches with holes there-through; these horizontal branches extending toward the panels inner faces. In this formwork, the horizontal branches overlap one another with the holes in register and tie-rods are provided which have a central portion located between the sidewalls and bent end portion extending through the registering holes and into the panels upper hinges; elbows between the portions fitting into the first rabbets.

In a preferred embodiment, each modular panel is formed with a second rabbet opening onto one of the horizontal edges and onto the outer face; the panel further comprising a coplanar ledge projecting from the other of the horizontal edges in alignment with the second rabbet; the ledge and the second rabbet being sized to cooperate respectively with a second rabbet and with a ledge of like adjoining coplanar panels to form insulating lap joints therewith.

Preferably also, at least some of the angle-irons extend beyond the tongue-and-groove joints thereby horizontally interlocking adjacent panels.

The prior art cited in U.S. Pat. No. 4,742,659, mentioned above, has been reviewed by Applicant but not found pertinent to the invention as claimed herein.

Other objects and features of the invention will become apparent from the description that follows of a preferred embodiment, having reference to the appended drawings and given as an example only as to how the invention may be put into practice.

BRIEF DESCRIPTION OF THE DRAWINGS

FIG. 1 is a shortened top plan view of a modular panel made according to the invention;

FIG. 2 is a cross-sectional view in a plane along line II—II of FIG. 1;

FIG. 3 is an elevation view of the panel of FIG. 1;

DESCRIPTION OF THE PREFERRED EMBODIMENT

Figure 4:
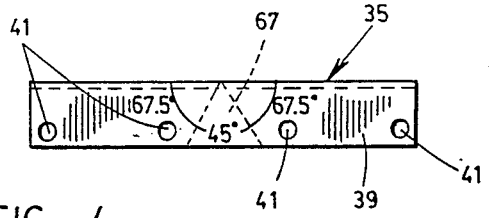
FIG. 4 is an elevation view of a straight angle-iron as used with the panel of FIG. 1.

Referring to FIGS. 1, 2 and 3, the modular panel is first cut as a generally rectangular body from a standard sheet of foam plastic material, preferably polystyrene. This panel is then formed with an upper longitudinal slit 5 extending lengthwise of its upper edge 7. It is also formed with another longitudinal slit 9 along the lower edge 11 and coplanar with the slit 5. Edge 11 is formed at the factory so as to leave out a ledge 31 to which reference is made below. Both slits extend fully between the end edges 13 and 15 of the panel 1 and are parallel to the inner and outer faces 17 and 19 of the panel.

The slits 5, 9, can easily be made in factory by a hot wire which makes it possible to use longer panels 1 thus reducing the number of vertical end joints between successive panels.

Also easily machined at the factory, is a first rabbet 21 which opens both onto the inner face 17 of the panel and onto its lower edge 11.

Each panel 1 is further formed, at the factory, with a tongue 25 along the vertical end edge 13 and with a groove 27 along the other end edge 15. The tongue 25 and groove 27 are appropriately dimensioned to cooperate, respectively, with a groove and a tongue of like adjoining coplanar panels to form vertical tongue-and-groove joints useful in resisting lateral pressure from the concrete mix as it is poured into the formwork.

Figure 8:
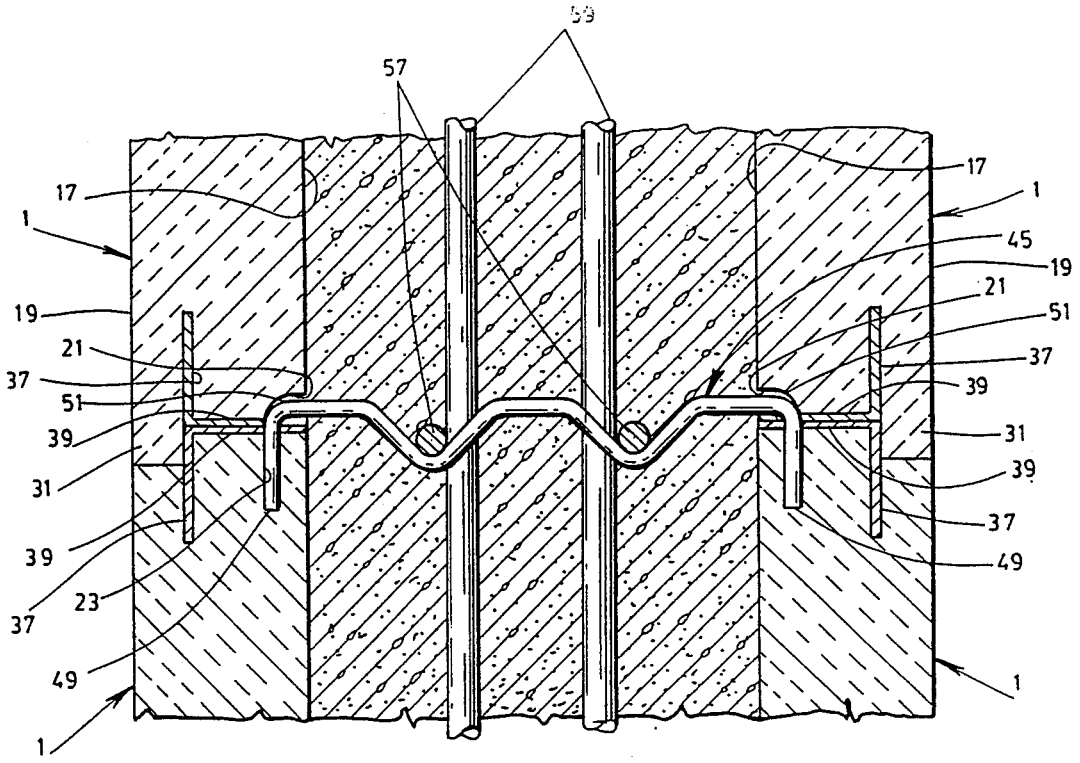
FIG. 8 is a transverse cross-sectional view of the formwork after the concrete mix has been poured.

Additionally provided on the panel 1 is a second rabbet 29 opening onto the upper edge 7 and also onto the outer face 19. In conjunction with it is the aforesaid ledge 31 which projects from the lower edge 11 and which is in vertical alignment with this second rabbet 29. As shown in FIG. 8, the ledge 31 and the rabbet 29 are properly dimensioned so as to cooperate, respectively, with a second rabbet and with a ledge of like adjoining coplanar panels to form insulating lap joints which serve to avoid the formation of thermal bridges between the outside of the concrete wall and the inside of the building.

The slits 5, 9; the first and second rabbets 21, 29, and the ledge 31 extend uninterruptedly between the end edges 13, 15.

As will be appreciated from the above description, the modular panel 1 can rapidly and easily be factory-made at low cost and does not require molding nor the embedding of inserts. As aforesaid, it can easily be cut out of a standard sheet of polystyrene foam.

Figure 7:
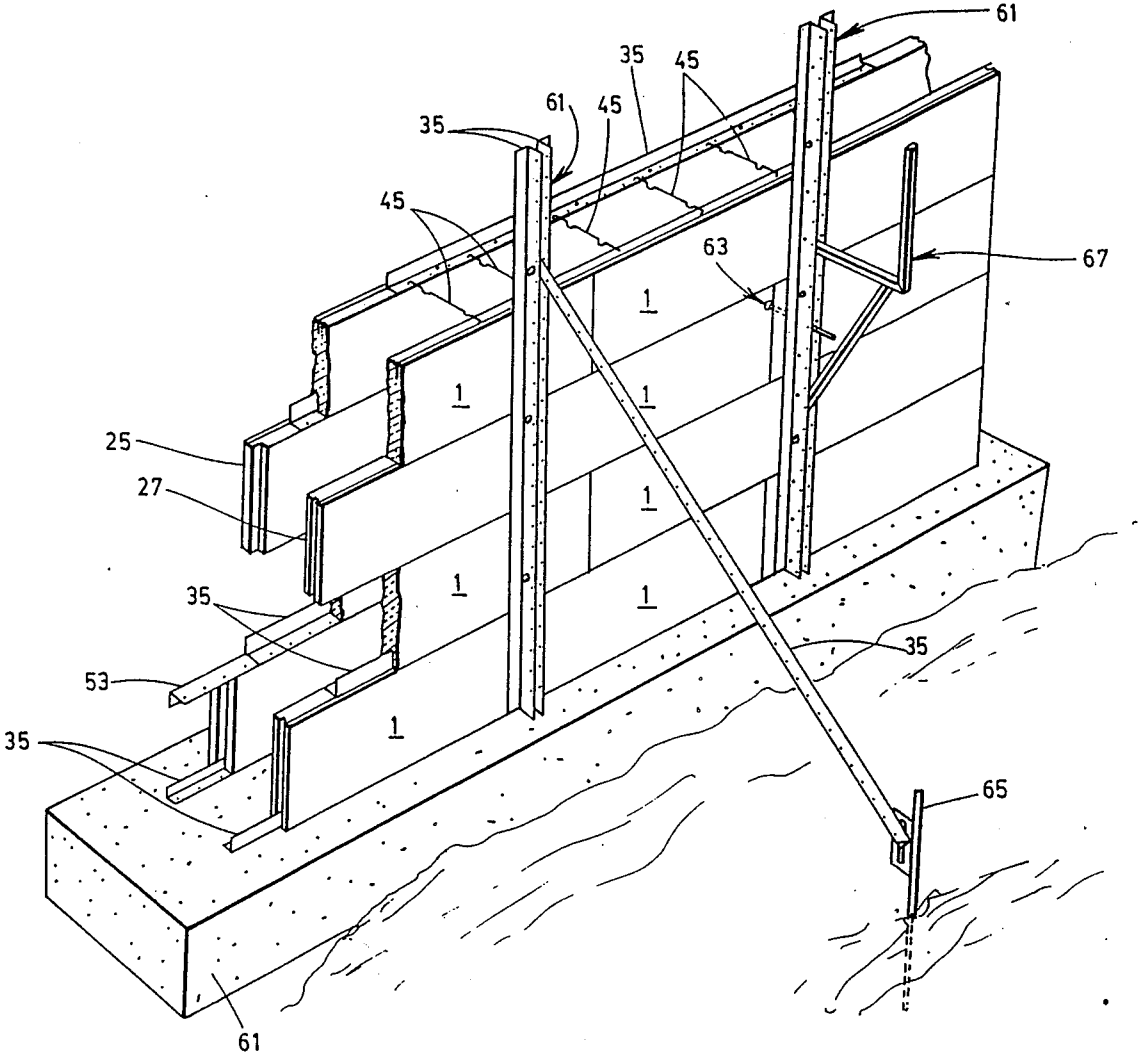
FIG. 7 is a perspective view of part of formwork made according to the invention.

As illustrated in FIG. 7, each sidewall of the formwork 33 is made up of a plurality of coplanar edge-abutting panels 1 with the tongues 25 and grooves 27 forming vertical joints and wherein the longitudinal slits 5 and 9 comprise, when the panels are assembled, upward slits in coplanar alignment with downward slits.

The panels 1 are held in vertical alignment by the aforesaid tongue-and-groove joints and in vertical as well as in horizontal alignment by angle-irons 35 each having a vertical branch 37 and a horizontal branch 39 at right angle to one another.

Referring to FIG. 8, a first group of such angle-irons have their vertical branches 37 fitting snugly into the upward slits 9 and their horizontal branches 39 are pierced with holes 41 and 43, of which the purpose is determined hereinbelow. The horizontal branches 39 extend toward and preferably up to the panels inner faces 17. A second group of angle-irons are similarly mounted but with their vertical branches 37 fitting into the downward slits 5. Their horizontal branches 39 are likewise pierced with holes 41 and 43 and extend toward and preferably up to the panels inner faces 17. Branches 39 overlap one another, as shown, in a manner such that their holes 41, being properly positioned, are in register.

Figure 9:
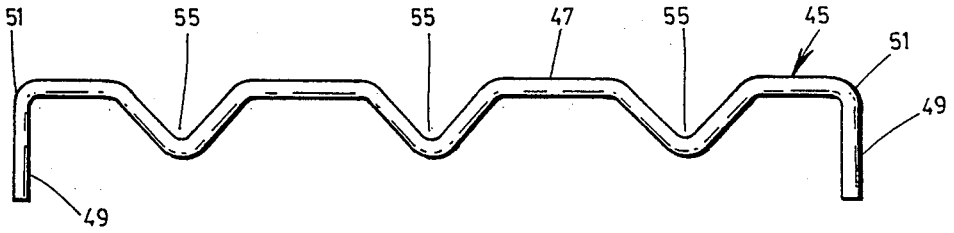
FIG. 9 is an elevation view of a tie-rod.

Tie-rods 45, such as those seen in FIGS. 8 and 9, serve to hold the formwork sidewalls in firm parallel vertical position during pouring of the concrete mix. Each tie-rod has a central portion 47 and their end portions 49 are bent out at right angle, joining the central portions 47 through elbows 51. As shown, the central portions 47 are located between the two sidewalls and their end portions 49 extend through the registering holes 41 and are forced into the panels, parallel to their faces, while the elbows 51 fit into the first rabbets 21.

With the above arrangement, not only are the sidewalls firmly held in proper spaced parallel position but, with the vertical branches 37 of sizeable length lodged snugly in the slits 5 and 9 and retained by the tie-rods 45, the vertical alignment of the coplanar modular slabs 1, and thus of the formwork sidewalls, is made safer. Resistance to the pressure developed by the concrete mix, as it is poured, is further enhanced by extending the angle-irons 35 beyond the tongue-and-groove joints (such as at 53 in FIG. 7). This horizontal interlock between panels also serves to integrate all panels 1 into a solid sidewall along, of course, with the action of the vertical branches 37 in the slits 5, 9, and that of the tie-rods 45. It will be appreciated also that only three basic elements are required to build a concrete formwork according to the invention: the factory-made but not molded modular panel 1; the angle-ion 35 and the tie-rod 45.

The latter may advantageously be V-bent along its central portion 47 to define nicks 55 into which are seated horizontal reinforcement bars 57. Vertical reinforcement bars 59 may also be added, if needed, and secured to the bars 57 and the tie-rods 45 in a manner known in the trade.

In building the formwork, two spaced rows of angle-irons 35 are first secured to a footing 61 (FIG. 7). The panels of the bottom row are then mounted over the angle-irons by their slits 9 and after their ledges 31 have been removed so that they may sit squarely on the footing by their lower edges 11. Once the two bottom rows of panels are set into position and connected vertically by their tongue-and-groove joints, additional angle-irons are slid by their downward branches 37 into the slits 5. Other angle-irons are placed over them with the holes 41 in register and then end portions 49 of tie-rods 45 passed through the holes 41 and driven into the panels, parallel to their faces 17 and 19. The second row of panels may now be placed over the bottom one by inserting the upward branches 37 of the tie-rods into the downward slits 9. Subsequent rows of panels are set in the same manner.

Figure 5:
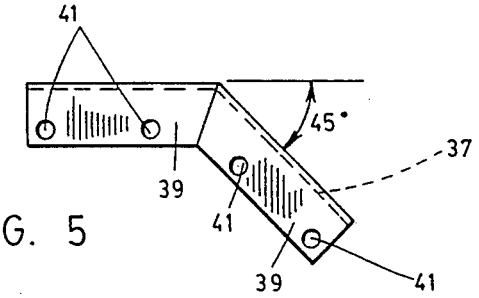
FIG. 5 elevation view of a corner angle-iron.

FIGS. 4 and 5 illustrate that still the same angle-irons 45 may be used in corners of the wall to be built. If a 45° bend is to be achieved, a 45° V-notch 67 is simply cut out of the horizontal branch 39 and the vertical branch 37 is bent at 45°. The same procedure is used for other angles, such as 90° bends.

Figure 6:
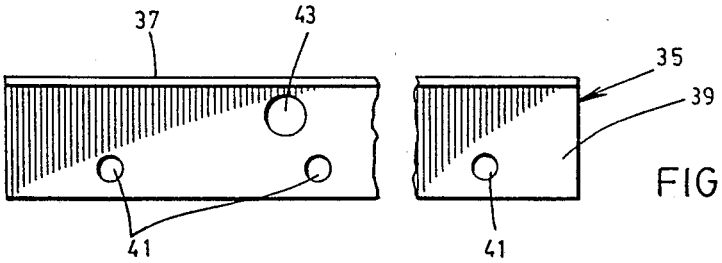
FIG. 6 is a shortened top plan view of an angle-iron for use as a scaffold post.

Finally, it may be advantageous, during assembly, to mount posts 61 on the sidewalls for providing vertical alignment of the successive rows one upon the others and preventing the panels 1 from lifting when concrete is poured. The posts may also be used in building a scaffold. Each post would consist of a pair of back-to-back slightly spaced angle-irons 35, temporarily held in place in any known manner against the sidewalls during concrete-mix casting. A stronger but releasable attachment is provided by conventional wall-tie anchors 63 of which the bolts extend between the two spaced angle-irons 35 to be fixed by washers and nuts applied against the free edges 7 of the angle-irons 35 while the anchoring bulbs lie within the formwork to become embedded in the concrete. The posts 61 may further be braced by another angle-iron 35 fixed to its at one end by bolts extending through holes 43 (FIG. 6) and to a ground stake 65 at the other end. Scaffold supports 67 may be fixed to the posts after the concrete has set and after the bracing angle-irons 35 have been removed.

I claim:

1. A concrete-wall formwork comprising:

a pair of formwork sidewalls each formed of a plurality of stacked horizontal rows of coplanar panels;

each panel being made of foamed plastic material and having flat inner and outer faces, upper and lower horizontal edges and vertical end edges, and including longitudinal coplanar slits extending lengthwise of said upper and lower edges parallel to said inner and outer faces, a first rabbit opening onto said inner face and onto said lower edge, and a tongue along one of said vertical end edges and a groove along the other vertical end edge, said tongue-and-groove being sized to cooperate, respectively, with a groove and a tongue of like adjoining coplanar panels to form tongue-and-groove joints therewith;

said panels abutting one another along said horizontal and vertical edges;

wherein ledges and second rabbets of adjoining panels operatively cooperate to form horizontal lap joints;

wherein tongues and grooves of adjoining panels operatively cooperate to form vertical tongue-and-groove joints spaced horizontally along said formwork sidewalls;

wherein longitudinal slits of adjoining panels comprise upward slits in coplanar alignment with downward slits;

a first group of angle-irons having vertical branches, fitting into said upward slits, and horizontal branches with holes therethrough; said horizontal branches extending toward the inner faces of said panels;

a second group of angle-irons having vertical branches, fitting into said downward slits, and horizontal branches with holes therethrough; said horizontal branches extending toward the inner faces of said panels;

wherein said horizontal branches overlap one another with said holes in register; and tie-rods having a central portion located between said sidewalls and bent end portions extending through said registering holes and extending int the upper edges of said panels, and elbows between said portions fitting into said first rabbets.

2. A formwork as claimed in claim 1, wherein at least some of said angle-irons extend beyond said tongue-and-groove joints thereby horizontally interlocking adjacent panels.

3. A formwork as claimed in claim 2, wherein each of said panels is formed with a second rabbet opening onto one of said horizontal edges and onto said outer face, and wherein each of said panels further comprises:

a coplanar ledge projecting from the other of said horizontal edges in alignment with said second rabbet; said ledge and said second rabbet being sized and cooperating respectively with a second rabbet and with a ledge of like adjoining coplanar panels to form insulating lap joints therewith.

4. A formwork as claimed in claim 3, wherein said second rabbets open into said upper edges and said ledges project from said lower edges.

5. A formwork as claimed in claim 4, wherein said slits, said first and said second rabbets and said ledges extend uninterruptedly between said end edges.

6. A formwork as claimed in claim 3, wherein said central portions of said tie-rods form nicks; said formwork further including horizontal reinforcing bars supported by said tie rods in said nicks.

7. A modular slab as claimed in claim 1, wherein said foam plastic material is expanded polystyrene.

8. A formwork as claimed in claim 1, wherein said foam plastic material is expanded polystyrene.

9. A formwork as claimed in claim 1, wherein said horizontal branches of said angle-irons extend up to said slab inner faces.

10. A formwork as claimed in claim 3, further comprising vertical reinforcing rods between said tie-rods.

* * * * *